US006014976A

United States Patent [19]

Denebeim

[11] Patent Number: 6,014,976

[45] **Date of Patent: *Jan. 18, 2000**

[54] SPHERICAL HAIR STYLING DEVICE

[76] Inventor: Sabrina R. Denebeim, 260 Avila St., San Francisco, Calif. 94123

[ * ] Notice: This patent is subject to a terminal disclaimer.

[21] Appl. No.: 09/008,280

[22] Filed: Jan. 16, 1998

Related U.S. Application Data

[63] Continuation of application No. 08/764,554, Dec. 12, 1996, Pat. No. 5,755,242, and a continuation-in-part of application No. 08/644,616, May 1, 1996, Pat. No. 5,711,323, which is a continuation-in-part of application No. 08/363,256, Dec. 23, 1994, Pat. No. 5,515,874.

[51] Int. Cl.[7] ..... A45D 1/04

[52] U.S. Cl. ..... 132/232; 132/313; 15/160

[58] Field of Search ..... 132/313, 120, 132/290, 308, 310, 311, 232; 15/159.1, 167.1, 205.2, 160, 164, 186, 187

[56] References Cited

U.S. PATENT DOCUMENTS

| | | | |
|---|---|---|---|
| D. 242,963 | 1/1977 | Glasberg . | |
| D. 365,685 | 1/1996 | Denebeim . | |
| D. 365,686 | 1/1996 | Denebeim . | |
| D. 366,152 | 1/1996 | Denebeim . | |
| D. 366,153 | 1/1996 | Stoller . | |
| D. 366,566 | 1/1996 | Denebeim . | |
| D. 374,776 | 10/1996 | Denebeim . | |
| 750,357 | 1/1904 | Gibbons . | |
| 800,422 | 9/1905 | White | 15/205.2 |
| 1,362,892 | 12/1920 | Pace . | |
| 1,473,977 | 11/1923 | Schaumberg . | |
| 1,671,891 | 5/1928 | Dolan | 15/167.1 |
| 2,632,191 | 3/1953 | Grafani et al. | 15/164 |
| 3,034,168 | 5/1962 | Walker | 15/164 |
| 3,173,429 | 3/1965 | Pauldine . | |
| 3,180,342 | 4/1965 | Dietsche | 132/120 |
| 3,204,646 | 9/1965 | Chamberlin . | |
| 3,413,984 | 12/1968 | Tracy et al. . | |
| 3,922,521 | 11/1975 | Viegut et al. . | |
| 3,955,064 | 5/1976 | Demetrio et al. . | |
| 4,023,578 | 5/1977 | Buhler . | |
| 4,030,158 | 6/1977 | Blair et al. | 15/186 |
| 4,166,472 | 9/1979 | Battaglia . | |
| 4,192,325 | 3/1980 | Liedtke . | |
| 4,222,398 | 9/1980 | Fromman . | |
| 4,250,902 | 2/1981 | Ihara . | |
| 4,291,431 | 9/1981 | Lewis, Jr. | 15/159.1 |
| 4,291,714 | 9/1981 | Mariani . | |
| 4,328,818 | 5/1982 | Glucksman . | |
| 4,365,426 | 12/1982 | Suzuki et al. . | |
| 4,378,814 | 4/1983 | Quevedo . | |
| 4,431,012 | 2/1984 | Brenn Albertoni . | |
| 4,502,496 | 3/1985 | Thomas et al. . | |
| 4,564,032 | 1/1986 | Araki . | |
| 4,625,738 | 12/1986 | Skovdal et al. . | |
| 4,877,942 | 10/1989 | Raab . | |
| 4,911,185 | 3/1990 | Losenno . | |
| 4,939,340 | 7/1990 | Brill . | |
| 4,953,574 | 9/1990 | Tsuji et al. . | |
| 5,054,153 | 10/1991 | Silliman . | |
| 5,212,366 | 5/1993 | McDougall . | |
| 5,327,611 | 7/1994 | Balster et al. . | |
| 5,353,463 | 10/1994 | Bracy, Jr. . | |
| 5,365,037 | 11/1994 | Chan . | |
| 5,479,951 | 1/1996 | Denebeim | 132/120 |
| 5,515,874 | 5/1996 | Denebeim . | |
| 5,584,307 | 12/1996 | Bauer et al. . | |
| 5,711,323 | 1/1998 | Denebeim . | |

FOREIGN PATENT DOCUMENTS

| | | |
|---|---|---|
| 0056605 | 12/1982 | European Pat. Off. . |

*Primary Examiner*—Gene Mancene
*Assistant Examiner*—Pedro Philogene
*Attorney, Agent, or Firm*—Majestic, Parsons, Siebert & Hsue

[57] ABSTRACT

A spherical hairbrush is provided to enable a user to obtain a helical curl having a continuum of varying diameters within each lock of curled hair. This varying-diameter helix provides a new and distinct look for the curled hair. The spherical hairbrush may include a spherical head. The spherical head may include holes that allow the hair to be quickly blow dried through the brush.

10 Claims, 6 Drawing Sheets

SPHERICAL HAIR STYLING DEVICE

This application is a continuation of Ser. No. 08,764,554 filed Dec. 12, 1996 now U.S. Pat. No. 5,755,242 and a continuation-in-part of application Ser. No. 08/644,616, filed May 1, 1996, now U.S. Pat. 5,711,323, which is a continuation-in-part of application Ser. No. 08/363,256, filed Dec. 23, 1994 now issued into U.S. Pat. No. 5,515,874 on May 14, 1996, herein referred to as the "Parent Applications."

BACKGROUND OF THE INVENTION

This invention relates generally to personal grooming devices, and more particularly to devices useful for hairstyling and for curling locks of hair.

Many persons with straight hair wish to temporarily alter their hairstyle through techniques such as curling, blow-drying, ironing, and/or perming. It has been customary in grooming hair to roll a tress or a plurality of strands of hair on a cylindrical curler or curling iron and to apply heat and/or a moistening agent to the hair. The hair is left in its rolled state until it has dried and set. Typically, for curling iron applications, the shaft of the curling iron is heated to a high temperature, which causes the hair to set quickly. After the hair has set, the cylindrical curler(s) or curling iron is removed and the hair retains a curl or wave imparted by the cylindrical curler or curling iron.

However, the curl imparted by a typical cylindrical curler or curling iron is limited to the constraints of a constant-diameter roller (of the curler) or the constant-diameter shaft of the curling iron. The resultant lock of hair which has been curled using this technique forms a helical shape having a relatively constant diameter. Small diameter cylindrical rollers or shafts produce small helixes and large diameter cylindrical rollers or shafts produce large helixes. Additionally, much of the space on the cylindrical curler or curling iron is wasted because a majority portion of each lock of hair is rolled around the center portion of the curler or curling iron, leaving the end portions of the curler or curling iron unused and visually devoid of hair.

It is therefore an object of the present invention to overcome the disadvantages associated with conventional cylindrical curlers or curling irons, and to provide a novel hairstyling technique for styling hair into shapes which cannot be achieved using conventional cylindrical curlers or curling irons.

SUMMARY OF THE INVENTION

This and additional objects of the present application are accomplished by the various aspects of the present invention, wherein briefly, according to a principal aspect, a hair styling device is provided with a spherically-shaped head to enable a user to obtain a helical curl having a continuum of varying diameters within each lock of curled hair. This varying-diameter helix provides a new and distinct look for the curled hair. In addition, the spherical configuration of the head of the hair styling device provides for less wasted space, and allows the full head of the hair styling device to be more completely utilized for each respective lock of hair.

According to an aspect of the present invention, a hairstyling device is provided which includes a hairbrush having a handle, a substantially spherical brush head, and a plurality of bristles radiating from the brush head.

In a preferred embodiment, vents or holes are provided in the spherical brush head to allow for quicker, easier drying of hair. Hot air from a blow dryer can pass through the spherical head from one side to dry the hair from the other side.

The brush of the present invention is able to curl the hair into helical-shaped curls of varying diameters instead of cylindrical-shaped curls obtained from conventional, cylindrical curling irons. The present invention makes it easier for the user to create curls in the back of the head. It also allows the user to do fuller, more convenient curling that flips upwards, and creates rounder, uniquely-shaped curls. The curls obtained using the ball-shaped brush of the present invention provide more fullness at the root of the hair because of the rounded shape of the curling head.

Additional objects, features and advantages of the various aspects of the present invention will become apparent from the following description of the preferred embodiment, which description should be taken in conjunction with the accompanying drawings.

DETAILED DESCRIPTION OF THE PREFERRED EMBODIMENT

Figure 1A:
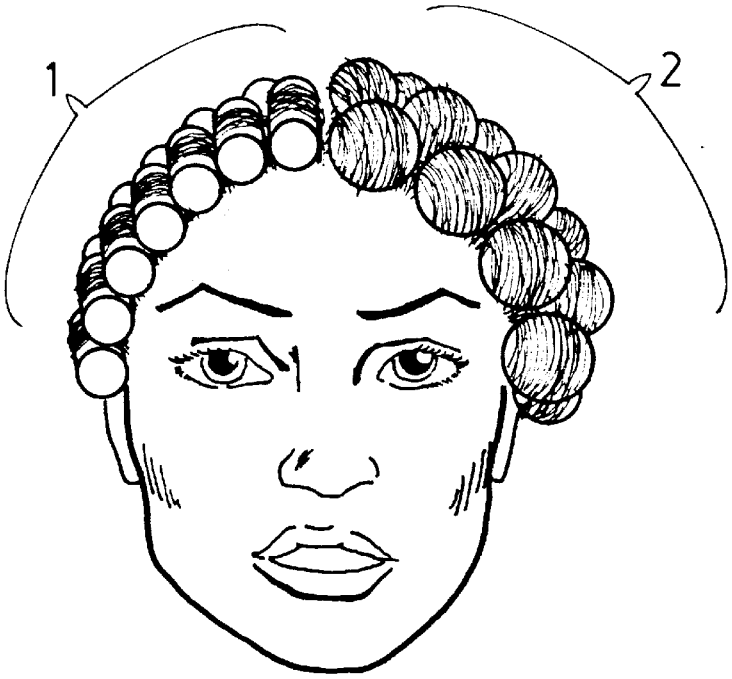
FIG. 1A shows a front view of a person using conventional curlers 1 on the left side of her head and using the spherical curlers 2 of the Parent Applications on the right side of her head.

FIG. 1A is a frontal view of a person with conventional curlers 1 on the left side of her head (as viewed by the viewer), and spherical curlers 2 on the right side of her head. Although the spherical curlers 2 in FIG. 1A are depicted as all being the same size, it is to be understood that the spherical curler of the Parent Applications may be manufactured in a variety of sizes, each of which is available to a user to be used as shown in FIG. 1A. Thus, spherical curlers of differing sizes may be used during a particular hairstyling session.

The unique spherical shape and different sizes of the curler of the Parent Applications also allow the user to apply more curlers to a given area of the scalp (or other desired portions of the head). This, in turn, allows a user to increase the actual amount of curls within a given area. The ability to increase the amount of curls creates a unique "maxi" curl style which heretofore has not been possible using conventional cylindrical curlers. Moreover, the very act of winding hair around the outer surface of the spherical curler itself induces the unique, full-bodied hair style, which is described in greater detail below.

Figure 1B:
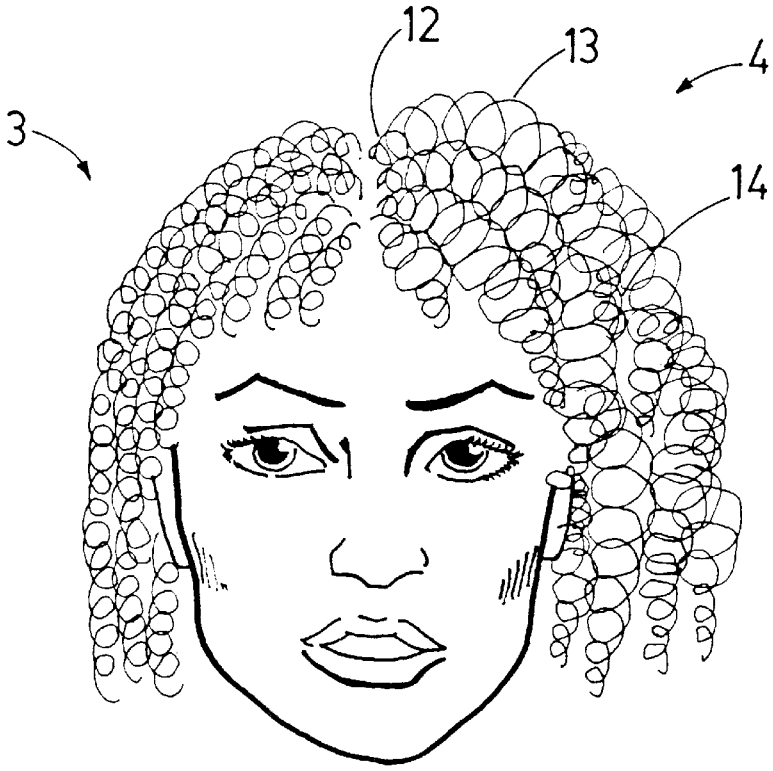
FIG. 1B illustrates the person's hair of FIG. 1A after the curlers have been removed, showing curls 3 resulting from conventional curlers and showing curls 4 resulting from the spherical curlers of the Parent Applications.

FIG. 1B illustrates the various resulting curls which form using the different types of curlers shown in FIG. 1A. It is to be noted that the curls shown in FIG. 1B are for illustrative purposes, and are intended to exemplify the differences between curls obtained from conventional cylindrical curlers and curls obtained from the spherical curler of the Parent Applications.

Curls generally depicted at 3 result from the conventional curlers 1 of FIG. 1A. A closer inspection of the curls 3 reveals that the conventional curler produces curls in a helical shape, wherein each of the curls in the helix has substantially the same diameter. This is the result of the hair being wrapped around a cylindrical curler which has a single diameter.

In contrast, the curls shown generally at 4 in FIG. 1B result from using the spherical curler of the Parent Applications, as shown in FIG. 1A. Because different portions of hair are wrapped around a single spherical curler at different locations on the curler, the diameter of the resulting curls will vary, depending upon the diameter portion of the spherical curler onto which each part of hair is wound. The curls 4 which result using the spherical curler of the Parent—Applications retain a helical shape with a continuum of differing diameters. For example, as shown in FIG. 1B, the resulting curls 4 start out having a small diameter 12, then progress to a larger diameter 13, and again reduce to a smaller diameter 14. Thus, the use of a spherical curler provides the unexpected advantage of producing a helical curl with a continuum of differing diameters, as shown generally at 4 in FIG. 1B.

In the Parent Applications, a spherical curler is described which enables the hair to be styled into a unique helical shape, attributable to the spherical shape of the curler. In the present application, the advantages associated with a spherically-shaped hair styling device have been applied to the field of hair curling irons and hair brushes. Thus, as described below, many of the advantages which result from using the spherical curler of the Parent Applications can also be achieved using the spherical hair brush embodiments described in the present application.

It is to be noted that, while the discussion below pertains primarily to the spherical curling iron embodiment of the present invention, the uses and advantages of the spherical hair styling device of the present invention described herein are equally applicable to the spherical hairbrush embodiment of the present invention.

Figure 2A:
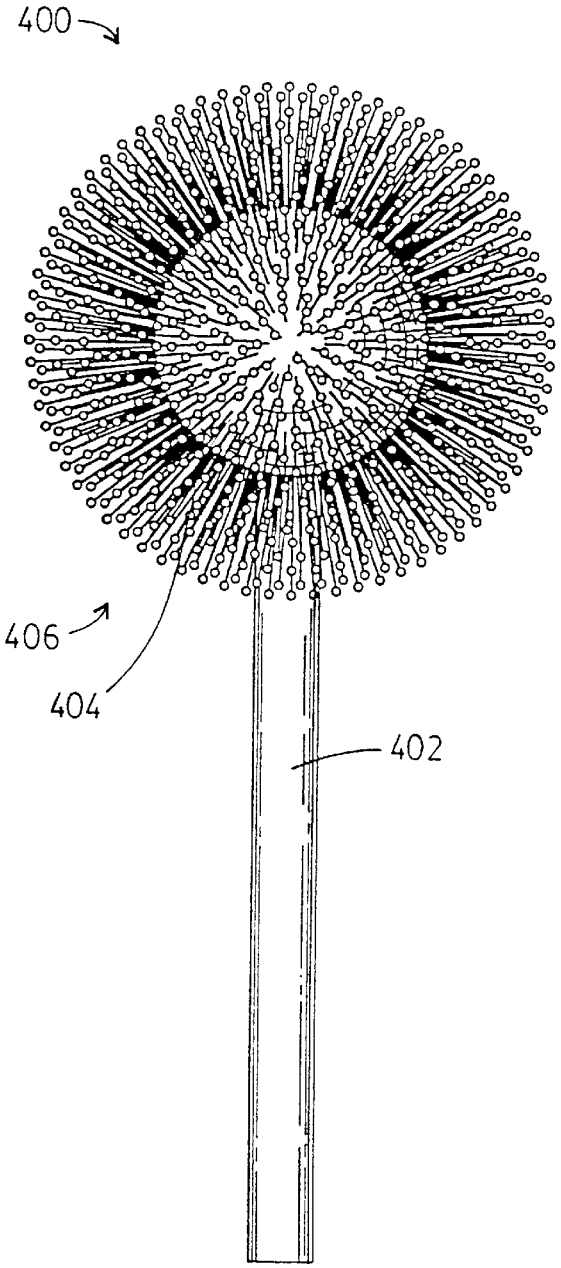
FIGS. 2A–2C illustrate one embodiment of the spherical hairbrush 400 of the present invention.
Figure 2B:
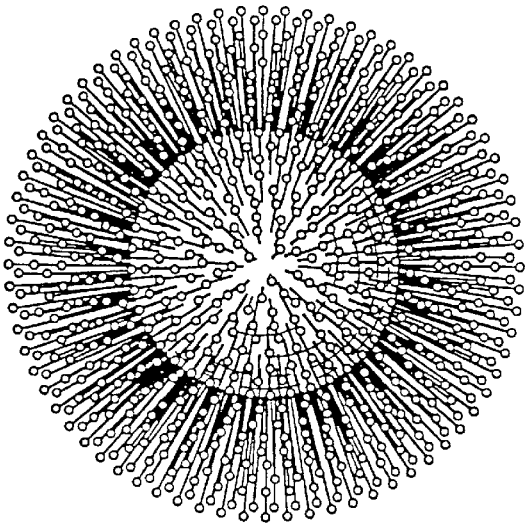
Figure 2C:
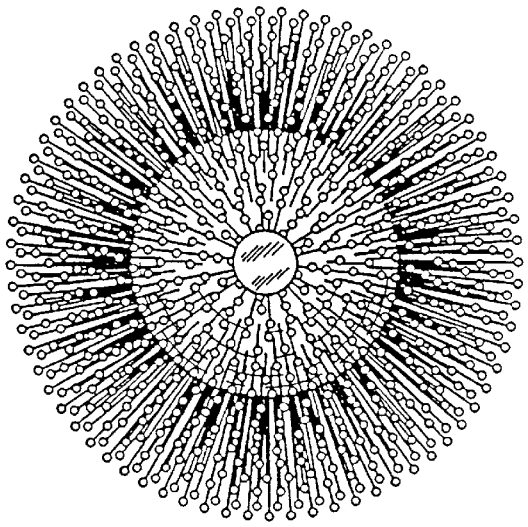

FIGS. 2A–2C illustrate one embodiment of the spherical hairbrush 400 of the present invention. FIG. 2A illustrates a frontal view of hairbrush 400. FIG. 2B illustrates a top view of hairbrush 400, and FIG. 2C illustrates a bottom view of hairbrush 400. As shown in FIG. 2A, hairbrush 400 comprises a handle 402, and a spherical brush head 404. Radiating out from the spherical brush head are a plurality of bristles 406.

Figure 3A:
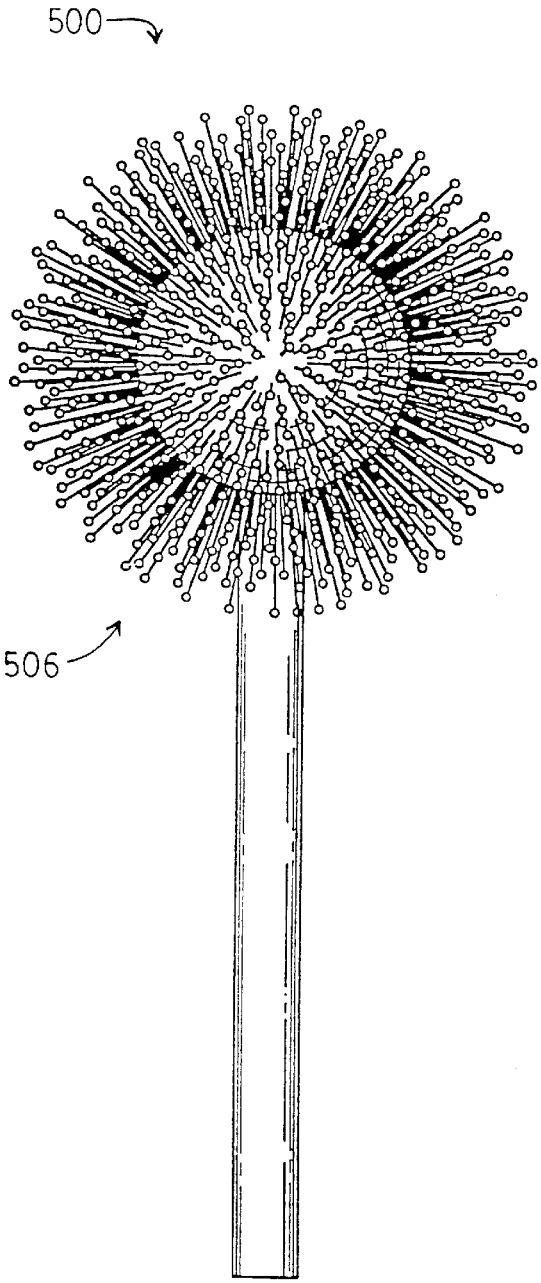
FIGS. 3A–3C illustrate an alternate embodiment of the spherical hairbrush 500 of the present invention.
Figure 3B:
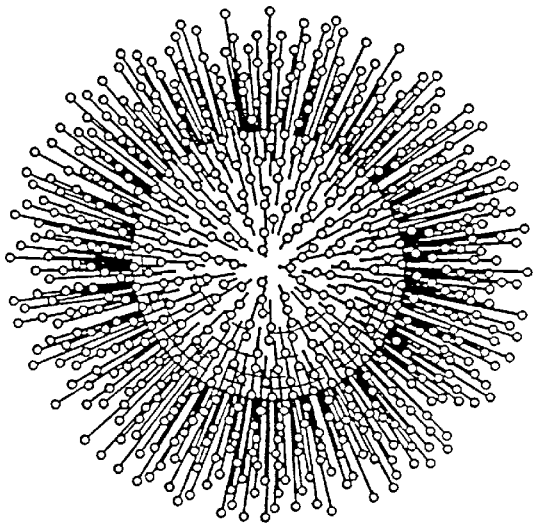
Figure 3C:
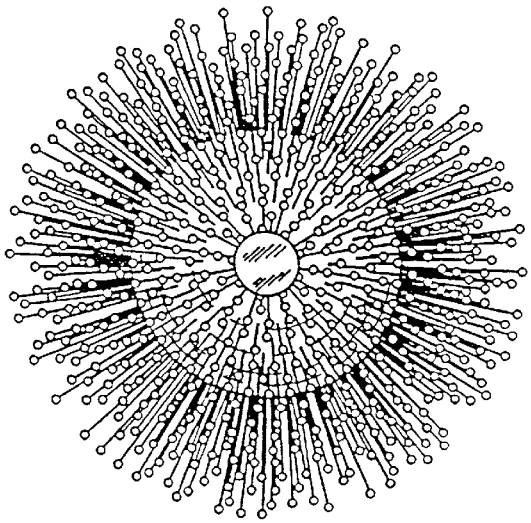

FIGS. 3A–3C illustrate an alternate embodiment of the spherical hairbrush 500 of the present invention. FIG. 3A illustrates a frontal view of hairbrush 500. FIG. 3B illustrates a top view of hairbrush 500, and FIG. 3C illustrates a bottom view of hairbrush 500. One difference between hairbrush 400 and hairbrush 500 is that the bristles 406 of hairbrush 400 are substantially the same length, while the bristles 506 of hairbrush 500 are of differing lengths.

The use and advantages of the spherical hairbrush of the present invention are similar to those described above with respect to the spherical curling iron of the present invention. Furthermore, the hairstyling advantages obtained by using the spherical hairbrush of the present invention are also similar to the advantages described in the Parent Applications with respect to the spherical curler, and therefore will not be repeated.

It is to be noted, however, that conventional hairbrushes are unable to provide the advantages and/or hair styling shapes obtained by using the spherical hairbrush of the present invention. Additionally, the unique shape of the spherical brush head of the present invention in combination with a hair-gripping bristle design as shown, for example, in FIGS. 2–6, allows the hairbrush of the present invention to be used in a manner which can not be duplicated using conventional, cylindrical hair brushes.

For example, a user using the hairbrush 400 shown in FIG. 2 of the drawings is able to wind a lock of hair around the spherical brush head of the hairbrush, and is then able to continue to wind or rotate the hairbrush while simultaneously moving the position of the brush head to another portion of the scalp to thereby cause an additional section of hair to be wound upon the hairbrush while the previous section of hair is shaped and released.

Starting from the top portion of the brush head, there is a continuum of circles of bristles which gradually increase in diameter until the middle portion of the brush head is reached. As the hairbrush is rotated and moved laterally, this continuum of increasing circles of bristles acts as a spiral or cork-screw which initially grabs the hair at the top portion of the brush head, winds the hair around the middle portion of the brush head, and eventually releases the hair at the bottom portion of the brush head.

Due to the unique shape of the spherical brush head of the present invention, the diameter of the circle of bristles at the top portion of the brush head is smaller than the diameter of the circle of bristles at the middle portion of the brush head. As the hairbrush is rotated and simultaneously moved across a portion of the scalp such as, for example, the bang area where the hairline meets the forehead, the smaller circle of hair-gripping bristles initially grabs the hair and wraps the hair around the body of the brush head. As the hair-brush is continually rotated and moved laterally along the hairline, the spiraling effect of the bristles causes each portion of hair to be wrapped around the middle portion of the spherical brush head and ultimately released at the bottom portion of the brush head. Simultaneously, new locks of hair are continually being grabbed by the bristles at the top portion of the brush head and spiraled inward towards the middle section. Using this technique, it is possible to style hair both quickly and conveniently and to obtain fuller, richer curls as compared to hair styling techniques using conventional, cylindrical hairbrushes. Moreover, conventional hairbrushes are not able to provide the hair spiraling function that is achievable using the spherical hairbrush of the present invention in combination with hair-gripping bristles.

Additionally, the spherical shape of the brush head of the present invention permits a user to continuously rotate the brush head even after an entire lock of hair has been wound around the brush head. This is also true for the spherical curling iron embodiment of the present invention. That is, the spherical curling iron may be continually rotated even after an entire lock of hair has been wound around the curling iron. As the spherical hair styling device is continually rotated, the lock of hair which is wrapped around the device is allowed to slip, and, because of its spherical shape, the top and bottom portions of the spherical brush or curling iron head taper away from the middle section where the brush or curling iron head meets the scalp. This tapering effect allows hair which has been wrapped around the brush or curling iron head to easily slip away and/or release itself from the head of the hair styling device. With conventional, cylindrical hair-brushes or curling irons, however, once the hair has been completely wound upon the shaft or head of the brush or curling iron, the brush or curling iron is not able to be rotated further without pulling the hair.

The embodiments of FIGS. 4–6 include holes defined into the spherical head to allow the hair brushed by the brush with the spherical head to dry more quickly. The air from a blow dryer can pass through the holes on one side of the brushes to holes defined on the other side of the brushes, thereby drying the strands of hair positioned on the side of the spherical hair brush opposite the hair blower. Additionally, air from the blow drier can circulate within the brush head, warming up the brush from the inside, and thus aid in the styling of the hair. Furthermore, the use of vents or holes makes the brush-head lightweight and thus easier to use. A lightweight brush-head in the head can be moved more quickly through the hair.

In order to facilitate the use of these holes in the spherical hair brush, in a preferred embodiment, the spherical hair brush has a hollow spherical brush head. The hollow head is lightweight and thus easier to use. The spherical hair brush of FIGS. 4–6 allows for the improved curls to be made quicker and more efficiently.

Figure 4A:
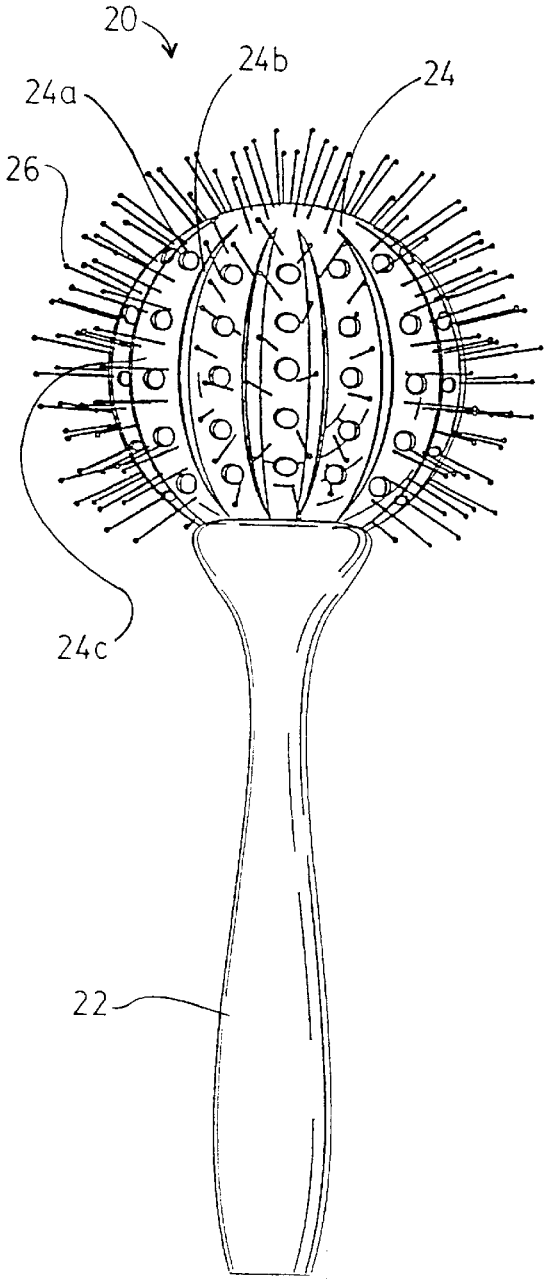
FIGS. 4A–4C illustrate another alternate embodiment of the spherical hair brush of the present invention.
Figure 4B:
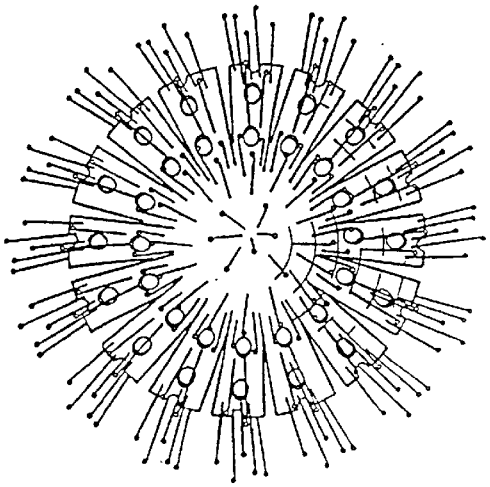
Figure 4C:
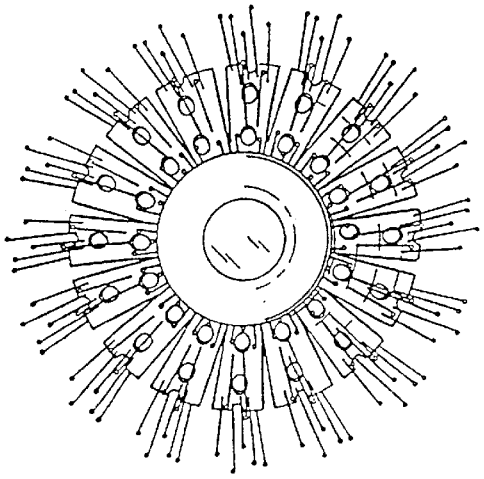

FIGS. 4A–4C illustrate another alternate embodiment of the spherical hair brush 20 of the present invention. FIG. 4A illustrates a frontal view of the hair brush 20. FIG. 4B illustrates a top view of the hair brush 20, and FIG. 4C illustrates the bottom view of the hair brush 20. As shown in FIG. 4A, hair brush 20 includes a handle 22, a spherical brush head 24, and bristles 26. In the embodiment shown in FIG. 4A, the spherical brush head 24 is hollow and has defined there-on a number of holes. These holes include spherical holes 24*a* and slivers 24*b*. These circular holes 24*a* and slivers 24*b* allow the air from a hair blower to pass through the spherical brush head 24, thereby aiding in the drying and shaping of the hair. The spherical hair brush 24 in the preferred embodiment is hollow and has a series of plastic strips 24*c* on which the circular holes 24*a* are defined.

Figure 5A:
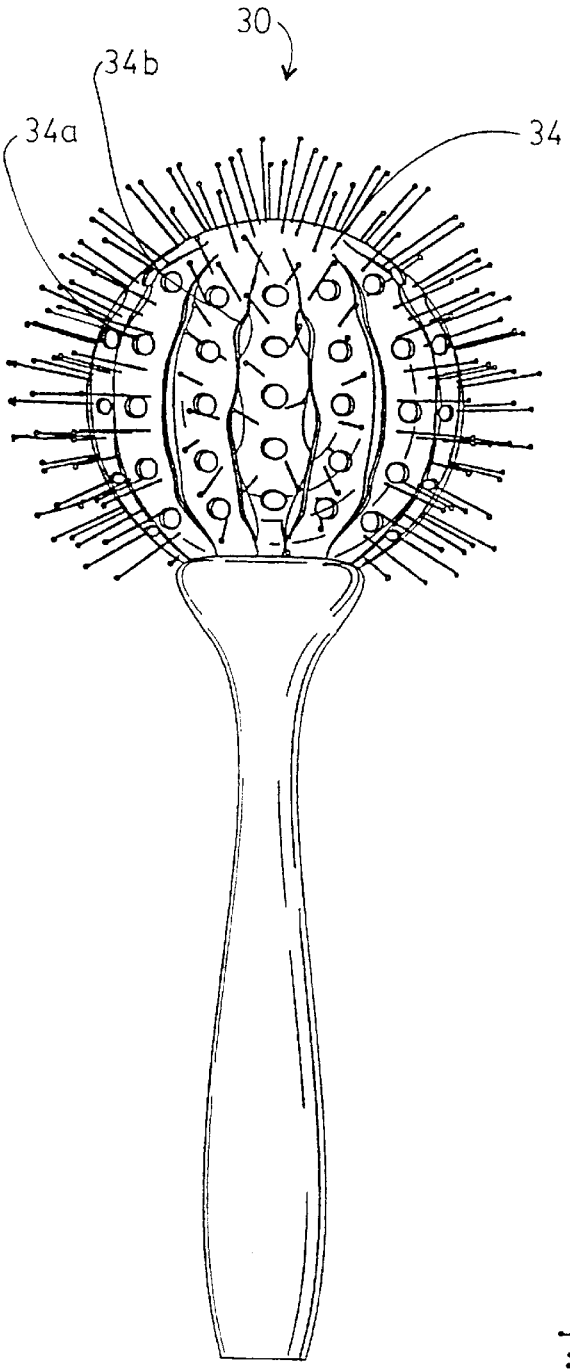
FIGS. 5A–5C illustrate yet another alternate embodiment of the spherical hair brush of the present invention.
Figure 5B:
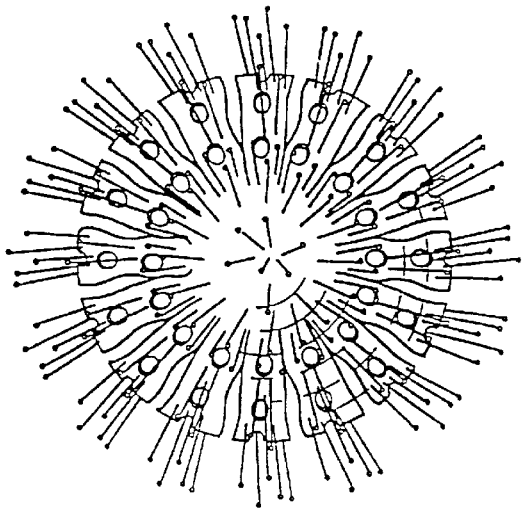
Figure 5C:
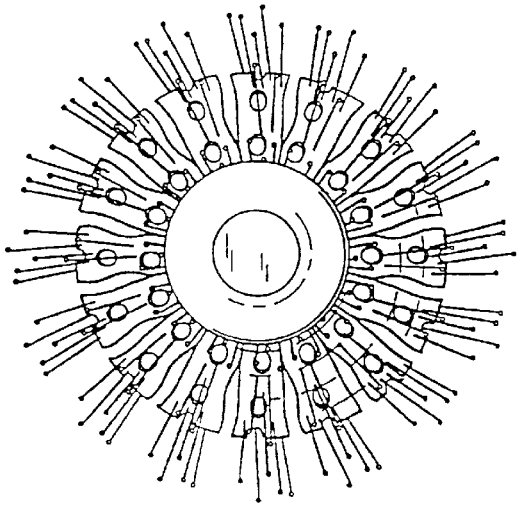

FIGS. 5A–5C illustrate yet another alternate embodiment of the spherical hair brush 30 of the present invention. FIG. 5A illustrates a frontal view of the hair brush 30. FIG. 5B illustrates a top view of the hair brush 30. FIG. 3C illustrates a bottom view of the hair brush 30. One difference between the hair brush 20 and the hair brush 30 is that the vents 34*b* on the spherical head 34 are wavy-shaped rather than sliver-shaped. The spherical head 34 also includes the circular holes 34*a*.

Figure 6A:
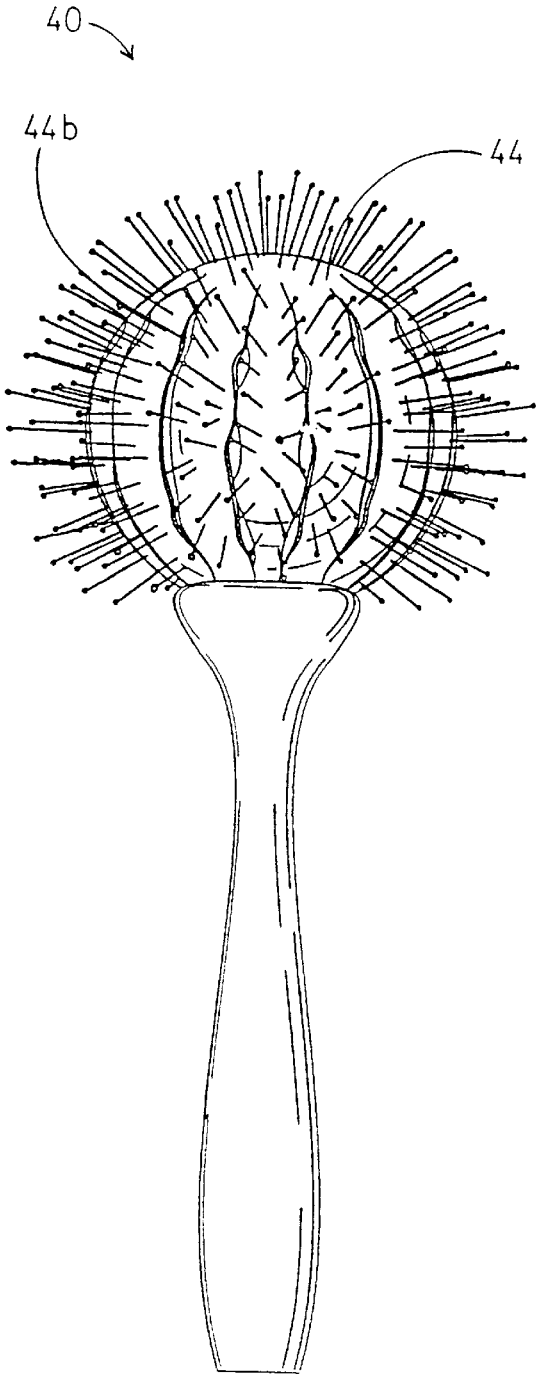
FIGS. 6A–6C illustrate still another alternate embodiment of the spherical hair brush of the present invention.
Figure 6B:
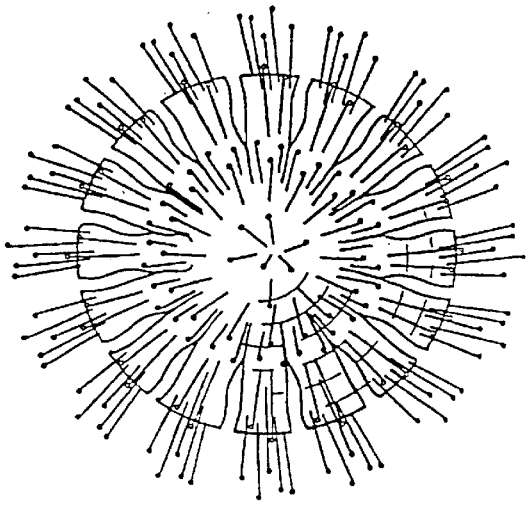
Figure 6C:
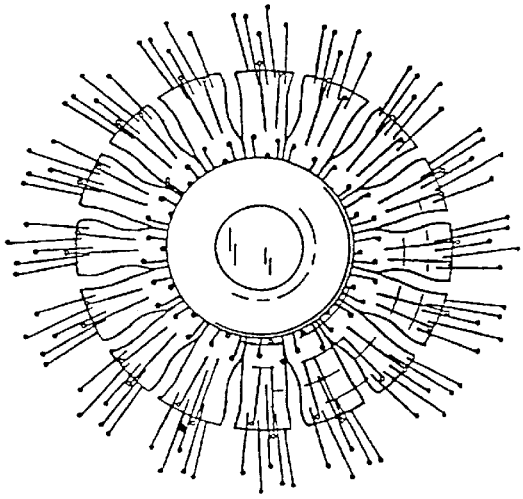

FIGS. 6A–6C illustrate still another alternate embodiment of the spherical hair brush 40 of the present invention. FIG. 6A illustrates a frontal view of the hair brush 40. FIG. 6B illustrates a top view of the hair brush 40, and FIG. 6C illustrates a bottom view of the hair brush 40. The spherical head 44 includes the wavy vents 44*b*, but does not include any holes formed in the strips defined by the vents 44*b*.

For each of the embodiments of FIG. 3 through FIG. 6, the holes are preferably formed on all sides of the spherical head so that from whatever direction the hair blower is pointed towards the spherical head, there will be holes on both sides. In this manner, hot air can pass from one end to the other, drying the hair on the opposite side of the spherical head from the hair blower which would ordinarily be blocked by the head. Additionally, hot air can circulate within the brush-head and come out more than one vent or hole.

The use of the vents and holes for these embodiments has a special advantage with a spherical-shaped head, because it allows for the hair to be dried quickly into the full-body shape as shown in FIG. 1B. Because the spherical hair brush can style different hair locations without being released from the hair, it is desirable to dry the hair relatively quickly as the brush is moved along in the hair. The holes or vents aid in this dying process.

Although several preferred embodiments of this invention have been described in detail herein with reference to the accompanying drawings, it is to be understood that the invention is not limited to these precise embodiments, and that various changes and modifications may be affected therein by one skilled in the art without departing from the scope or spirit of the invention as defined in the appended claims.

What is claimed is:

1. A component for a hair styling device comprising:

a brush head having a substantially spherical shape, wherein the brush head defines holes which allow the passage of air through the brush head; and a plurality of projections radiating out from said brush head, the plurality of projections sized to style human hair.

2. The component for a hair styling device of claim 1 wherein the projections are bristles.

3. The component of claim 2 wherein the bristles are hair gripping bristles having a hair-engaging element at a tip of the bristles.

4. A hair styling device using the component of claim 1, further comprising a support element connected to the brush head.

5. The component of claim 1 wherein the brush head is hollow.

6. The component of claim 1 wherein the brush head is made of a plastic material.

7. The component of claim 6 wherein the brush head comprises strips of plastic material.

8. The component of claim 7 wherein the strips include holes.

9. The component of claim 1 wherein each of said plurality of bristles are substantially the same length.

10. The component of claim 1 wherein said plurality of bristles have differing lengths.

* * * * *